US009028320B2

(12) United States Patent
Romano

(10) Patent No.: US 9,028,320 B2
(45) Date of Patent: May 12, 2015

(54) APPARATUS AND METHOD FOR GENERATING NUMBERS

(76) Inventor: James P. Romano, Syracuse, NY (US)

( * ) Notice: Subject to any disclaimer, the term of this patent is extended or adjusted under 35 U.S.C. 154(b) by 165 days.

(21) Appl. No.: 13/430,109

(22) Filed: Mar. 26, 2012

(65) Prior Publication Data

US 2012/0184350 A1 Jul. 19, 2012

Related U.S. Application Data

(63) Continuation of application No. 10/436,040, filed on May 12, 2003, now abandoned.

(51) Int. Cl.
*A63F 9/24* (2006.01)
*G07C 15/00* (2006.01)

(52) U.S. Cl.
CPC ..... *G07C 15/006* (2013.01)

(58) Field of Classification Search
CPC ..... H04L 27/152; G06F 7/58; G06F 7/582; G06F 7/588; G06F 21/32; G06K 19/007345; G06K 19/0718; G06K 2009/00006; G06K 9/00375; G06K 9/00885; H03K 3/84; G07C 15/00; G07C 15/006
USPC ..... 463/22; 380/251; 331/18, 30; 235/462.27; 307/106; 702/66, 124; 382/116, 124; 713/186
See application file for complete search history.

(56) References Cited

U.S. PATENT DOCUMENTS 3,653,026 A 3/1972 Hurley
3,825,255 A 7/1974 Kennard et al.
3,838,295 A 9/1974 Lindell
4,032,764 A 6/1977 Savage
4,047,008 A 9/1977 Perkins
4,060,242 A * 11/1977 Huang et al. ..... 273/454
4,093,223 A * 6/1978 Wilke et al. ..... 463/4
4,151,404 A 4/1979 Harrington et al.

(Continued)

FOREIGN PATENT DOCUMENTS

GB 1386377 3/1975

OTHER PUBLICATIONS

Peyravian, et al. ("Generating User-Based Cryptographic Keys and Random Numbers," Computers and Security, vol. 18, No. 7, pp. 619-626, 1999).*

(Continued)

*Primary Examiner* — David L Lewis
*Assistant Examiner* — Matthew D Hoel
(74) *Attorney, Agent, or Firm* — David L. Nocilly; George R. McGuire; Bond Schoeneck & King, PLLC

(57) ABSTRACT

A hand held device includes an oscillator driving a microcontroller having as a part of its program a counter actuable by a user to initiate a program count function, counting through a predetermined range of numbers until the program count function is terminated manually at any moment of the user's choosing. A further feature permits the base frequency of the oscillator, and thus the counting rate of the counter, to be varied as a function of some external parameter such as a biometric parameter of the user, for example, by detuning the oscillator through a touch pad on the device housing. Visual and/or audible indicia provide a perceptible indication of the relative counting rate. A further, optional feature permits replacement game parameter data to be downloaded from an external source, and stored in nonvolatile memory for use by the microcontroller.

11 Claims, 6 Drawing Sheets

(56) References Cited

U.S. PATENT DOCUMENTS

| | | | | | |
|---|---|---|---|---|---|
| 4,153,933 | A | | 5/1979 | Blume et al. | |
| 4,188,779 | A | | 2/1980 | Fatton | |
| 4,213,189 | A | * | 7/1980 | Mueller et al. | 345/551 |
| 4,312,511 | A | | 1/1982 | Jullien | |
| 4,496,148 | A | * | 1/1985 | Morstain et al. | 463/9 |
| 4,578,649 | A | | 3/1986 | Shupe | |
| 4,586,710 | A | | 5/1986 | Beam | |
| 4,665,502 | A | * | 5/1987 | Kreisner | 463/22 |
| 4,684,903 | A | | 8/1987 | Hunt et al. | |
| 4,692,863 | A | | 9/1987 | Moosz | |
| 4,819,818 | A | | 4/1989 | Simkus et al. | |
| 4,858,122 | A | | 8/1989 | Kreisner | |
| 4,948,284 | A | | 8/1990 | Lingott | |
| 4,981,296 | A | * | 1/1991 | Shiraishi et al. | 713/501 |
| 5,007,087 | A | * | 4/1991 | Bernstein et al. | 380/46 |
| 5,157,602 | A | | 10/1992 | Fields et al. | |
| 5,204,671 | A | | 4/1993 | Kornberg | |
| 5,257,179 | A | * | 10/1993 | DeMar | 463/25 |
| 5,356,144 | A | | 10/1994 | Fitzpatrick et al. | |
| 5,401,023 | A | * | 3/1995 | Wood | 463/13 |
| 5,470,081 | A | | 11/1995 | Sato et al. | |
| 5,588,912 | A | | 12/1996 | Schumacher et al. | |
| 5,601,287 | A | | 2/1997 | Lundin | |
| 5,768,382 | A | * | 6/1998 | Schneier et al. | 380/251 |
| 5,873,781 | A | | 2/1999 | Keane | |
| 5,987,483 | A | | 11/1999 | Edelkind et al. | |
| 6,028,593 | A | * | 2/2000 | Rosenberg et al. | 345/156 |
| 6,215,874 | B1 | | 4/2001 | Borza et al. | |
| 6,501,284 | B1 | | 12/2002 | Gozzini | |
| 6,647,133 | B1 | | 11/2003 | Morita et al. | |
| 6,885,747 | B1 | | 4/2005 | Scheidt et al. | |
| 7,020,283 | B1 | | 3/2006 | Wada et al. | |
| 2002/0142844 | A1 | | 10/2002 | Kerr | |
| 2003/0072475 | A1 | * | 4/2003 | Tamori | 382/124 |

OTHER PUBLICATIONS

"Generating User-Based Cryptographic Keys and Random Numbers," Peyravian, et al., Computers and Security, vol. 18, No. 7, pp. 619-626, 1999.*

Intel Pentium datasheet from Jun. 1997, downloaded Aug. 27, 2014 from http://www.intel.com/design/pentium/datashts/24199710.pdf.*

DE 199 07 600 A1, pub. Apr. 2000; CA 2 217 916 A, pub. Aug. 2000. Derwent abstracts for DE 199 07 600 A1 and CA 2 217 916 A.

* cited by examiner

| FIG. 3A | FIG. 3B | FIG. 3C |
|---|---|---|

APPARATUS AND METHOD FOR GENERATING NUMBERS

CROSS-REFERENCE TO RELATED APPLICATIONS

The present application is a continuation of application Ser. No. 10/436,040, filed on May 12, 2003.

BACKGROUND OF THE INVENTION

1. Field of the Invention

The present invention relates to the electronic generation of one or more numbers in a chance-related manner. More specifically, the invention relates to number generation by an electronic clock or counter with selective controls for initiating and terminating operation of the counter, i.e., the "counting" operation, as well as means for selecting the range or set from which numbers are to be selected, and the number of selections to be made, i.e., how many numbers will be generated to form the required number set. The invention further relates to various schemes for varying the counting rate.

2. Description of the Related Art

Generation of numbers in a random manner is virtually as old as the concept of numbers itself. The chance selection of one or more numbers is often made the subject of a game with rules related to the significance of the selected number(s). For example, the flipping of a coin or casting of one or more dice, if performed in a manner which precludes conscious manipulation of the outcome, yields what may be termed a chance-generated result. In fact, it is the very randomness of the numeric selection process, i.e., the practical impossibility of predicting the outcome of an individual selection transaction, that defines number-related gaming or gambling. At least, this is the case for the individual or short term sequence of random number selection, ignoring the application of probability theory (the "law of averages") after many repetitions of the operation.

Although sweepstakes or lottery games have been in practice for centuries, their widespread adoption by governmental bodies in the United States (primarily at the state level) has been quite recent. There are at present some 37 states, plus the District of Columbia, offering a total of more than 175 number-selection lottery games, some 55 of which may be said to be unique (the others simply being repeated in a plurality of states). The games wherein preselected numbers, symbols, or other devices are printed on cards and revealed only after the player has purchased the card are not within the scope of the invention, only those games which involve prediction by the player of number(s) to be subsequently selected in a random manner.

Of course, every player has his or her favorite way of predicting the numbers which will be randomly selected in the manner prescribed by the particular lottery operation. Some players prefer to select the numbers in an essentially random manner, much like the way in which the winning numbers are selected. To this end, there are numerous random number generators available which operate electronically while remaining simple and inexpensive enough to appeal to a mass market. Typically, the user manipulates a switch to initiate operation of a clock, i.e., an electronic counter with a fixed counting rate, typically from several thousand to over a million numbers per second depending on the particular components chosen by the manufacturer of the device. After a time interval which is also a function of the electronic components, cycling stops and the number present in the counter at that instant is displayed and/or stored in the device. The process is repeated until the desired quantity of numbers has been selected. The duration of the time interval is intentionally established electronically in a manner which is imprecise with respect to the counting rate so that the counter does not stop at the same number for each repetition. However, the counter stops and the number is selected, at each repetition, under control of the built-in electronics and not the user. Additionally, these numbers can, and often are, generated mathematically using algorithms known as pseudo-random number generators. These also are not subject to user control.

BRIEF SUMMARY OF THE INVENTION

It is a principal object of the present invention to provide electronic apparatus for, and a method of, generating a number or sequence of numbers wherein the user exercises a degree of control over the selection process but does not know what number will be selected.

Typically, a single lottery authority (state) offers a plurality of games having different parametric game data (lowest and highest number values used, how many numbers are selected, etc.). Likewise, a lottery game in one state may have the same or different parameters from those in the games of other states, and the same name may be used in two or more states to indicate games with different parameters. Accordingly, it is useful to have a number generating device including manually manipulated input means for selecting a desired game, i.e., for causing the microcontroller to perform according to the parametric game data of the game chosen by the user.

It is another object to provide a number generating device for use in any of a plurality of number predicting games having differing game parameters wherein the device may be selectively initialized by the user in a simple manner to operate according to the parameters of a desired game.

Interest may be added to the electronic number selection process by offering to the user an interactive means for affecting the result, i.e., for changing the counting rate of the counter. Of course, the number(s) selected are still a function of the apparatus and are not known in advance to the user. Although the possibilities are numerous, one such means is a bio-feedback system wherein an input to the oscillator which establishes the operating frequency, and hence the counting rate of the counter driven thereby, is a function of some instantaneous physical attribute of the user, e.g., body reactance, temperature, pulse rate, blood pressure, etc.

It is a further object to provide an electronic device having a counter for counting repeatedly through a set of numbers wherein the counting rate is influenced by a contemporary physical condition of the user.

Additional objects are to provide electronic apparatus and methods for generating a number, or a set of N numbers, in a manner controlled by the user, wherein the apparatus/method includes one or more of the following: the device is incorporated in a wireless telephone; the counting rate of the device is affected by a plurality of sensing means; the numbers generated are stored in a memory for future access; the device includes a visual and/or audible indication of counting rate; the user refers to a chart of game names and locations (states) to obtain instructions for initializing the device to conform to the number selection criteria for the desired game.

Other objects will in part be obvious and will in part appear hereinafter.

In accordance with the foregoing objects, the invention envisions a relatively small and lightweight (hand held) case having a plurality of buttons (switches) for selective user actuation, a numeric display preferably of two digits, and LED displays for indicating various conditions of the device.

The case contains a microcontroller and power source such as a 9 volt, alkaline, transistor radio battery. The microprocessor is connected to an oscillator of conventional design through a counter of one or more stages which converts the pulse output of the oscillator to a square wave required for operation of the microcontroller program. Accompanying the device is a list or chart containing the names of all states (and the District of Columbia) where lottery games are offered, followed by the name of each game offered by each lottery authority. Each game is assigned an identifying number corresponding to its parametric game data, e.g., the numerical range (lowest and highest numbers in the set) and the number of selections to be made. The user actuates one or more of a plurality of game selector switches to enter the identifying number of the game to be played, thereby directing the microprocessor to operate according to the parametric data of that game.

When the desired game number is displayed the user presses a "select" button on the case which causes the microcontroller to execute a program count function, i.e., the counter which is implemented in firmware (part of the program which resides in the microprocessor's memory) begins counting through the set of allowable numbers in the selected game, and continuously recycles through this count. At any desired time, the user again presses the "select" button which causes the number present in the counter at that moment to be displayed and entered into memory for later playback, and, assuming more than one number is to be selected in the designated game, the counter resumes counting. Again, the "select" button is pressed at any time the user wishes to display and store the second number, and resume counting. This sequence is repeated until the number of selections for the designated game has been made. A "last #" indicator light (LED) will light after selection of the last number, and the computer enters the playback mode. Pressing the "end/results" button causes the computer to cycle through the memory. Following a second press of the "end/results" button, the selected numbers are sequentially shown in the display, beginning with the first number selected. This process continues until the "reset" button is pressed, following which the same game may be repeated or a different game may be initiated by entering a new game number in the game selection switch(es).

The oscillator base frequency, which controls counting speed, is established by the value of a capacitor in the oscillator circuit. In the basic version of the invention, the counting speed remains fixed although the user may actuate the processor at any desired time to select the number in the counter at that instant. The counting rate is sufficiently fast that the user cannot actually choose the number which will be in the counter at the moment of actuation. In an alternate, but preferred, version one or more sensors are incorporated in the device to affect counting speed. For example, the case may include a touchpad for contact by the user's hand or finger during the selection process. The reactance of the hand/finger acts as a detuning component of the circuit to reduce the oscillator frequency (counting rate). Other sensors may be used, individually or in combination, to vary oscillator frequency and thus counting rate. Visual and/or audible indicia may be provided on the case to indicate counting parameters (e.g., whether the counting rate is increasing or decreasing) to the user.

BRIEF DESCRIPTION OF THE SEVERAL VIEWS OF THE DRAWING(S)

The foregoing and other features of construction and operation of the apparatus and method of the invention will be more readily understood and fully appreciated from the following detailed disclosure, taken in conjunction with the accompanying drawings, where.

DETAILED DESCRIPTION OF THE INVENTION

Figure 1:
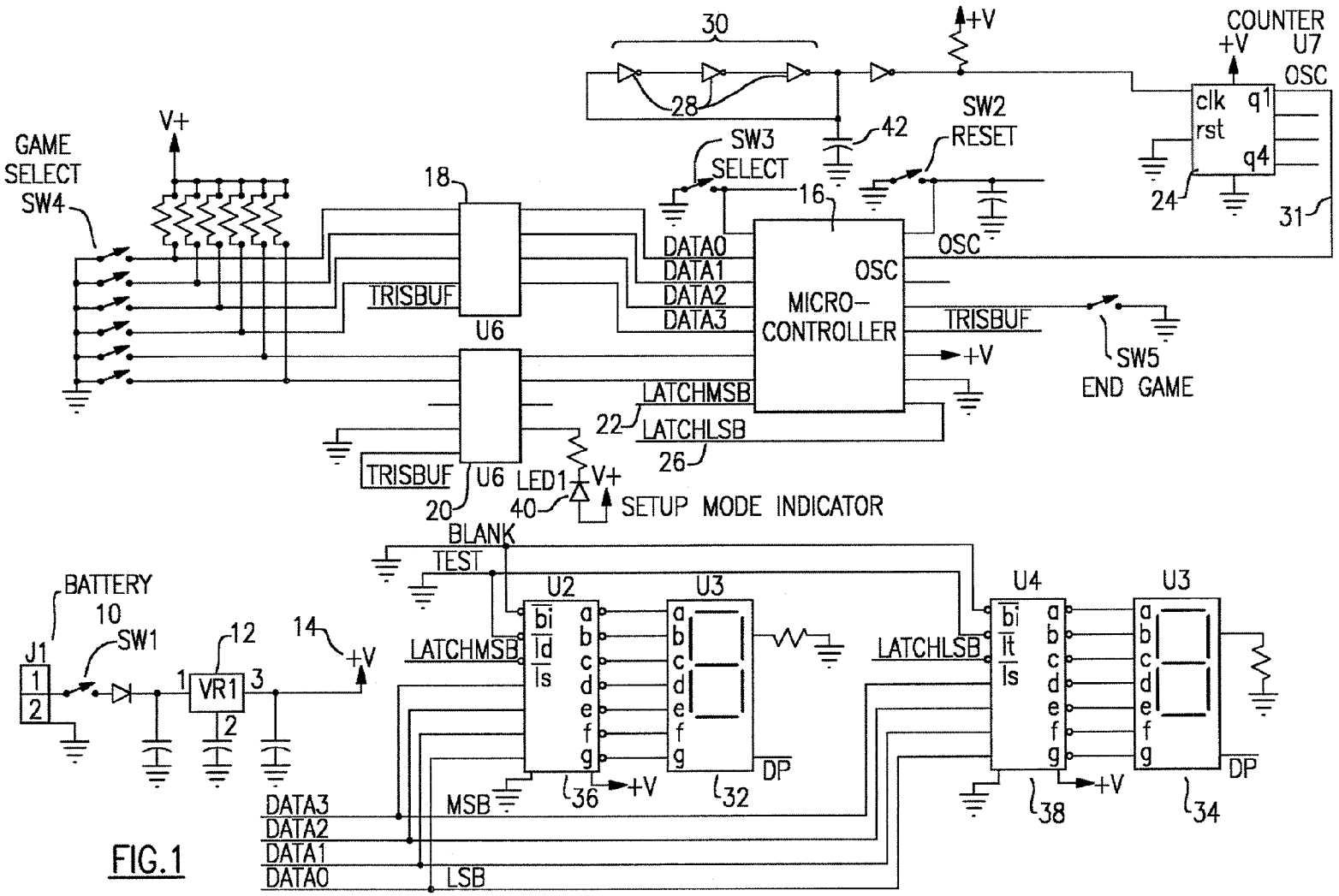
FIG. 1 is an electrical schematic diagram of circuitry embodying the invention in a first embodiment.

One form of circuitry for implementing the invention is schematically detailed in FIG. 1. Power is provided by 9 volt, alkaline (transistor radio type) battery 10 connected through on/off switch Sw1 to voltage regulator 12, providing the system operating voltage at terminal 14 for connection to the various other circuit locations indicated by V+. "Reset" and "select" switches Sw2 and Sw3, respectively, are connected to pins on opposite sides of microcontroller 16. "Game selector" switch Sw4 is shown as a plurality (six, in the illustrated version) of individually operable switches, four of which are connected through chip 18 and two through chip 20 to one side of microcontroller 16, along with switch Sw3 and latch output 22. Pins on the opposite side of microcontroller 16 are connected to "reset" switch Sw2, counter 24, "end game" switch Sw5, to ground and to latch output 26. An uneven number (3 in the illustrated design) of inverters 28 are connected in a ring fashion, as shown, to provide oscillator 30. As is the usual case, microcontroller 16 requires a 50% duty cycle, i.e., a square wave, to operate its program. Since the output of oscillator 30 is a pulse, it is applied to the first stage of counter 24 and thence (via line 31) to the clock input of microcontroller 16 as a square wave. In fact, in the present embodiment, counter 24 may be a single stage counter (i.e., a flip-flop) since its only purpose is to convert the pulse output of the oscillator to a square wave input to the microcontroller.

The numerical display of the illustrated circuit has two digits 32 and 34 although this may obviously be varied to accommodate all games which the device is expected to provide. Digits are displayed in conventional manner by electrical inputs to the appropriate ones of the seven segments forming each of the digits. Chips 36 and 38 which drive the digital display include inputs on lines indicated as blank, test and latch, in addition to the four indicated data inputs, and each chip provides seven outputs to the respective segments of the two digits forming the display. An optional, but preferred, setup mode indicator is provided by LED 40, connected between chip 20 and the regulated voltage.

To initiate a number selection process with the circuit of FIG. 1 the device is initialized and setup mode indicator 40 is turned on by placing switch Sw1 in the "on" position. The user then manipulates switch Sw4 in a prescribed manner to enable the controller program to operate according to the parametric game data of the desired game, i.e., the lowest and highest numbers in the set, the number of selections to be made and whether or not numbers may be repeated in the same set. This game selection operation is performed by the user placing the six switches denoted collectively as "game selector switch" Sw4 in positions prescribed for the game the user desires to play. This operation is expedited by providing to the user a list of the names of lottery games offered by each lottery authority (e.g., each state which operates lotteries, plus D.C.) with a number (or other designator) assigned to the games in a group having the same parameters. The user, after ascertaining the game designator from the list, enters via switch Sw4 the designator corresponding to the group including the lottery game which the user intends to play. Microprocessor 16, when in setup mode, continually reads the collective binary value of switch SW4 and causes the current value (i.e. game number) to be displayed. When the desired game is selected, the user then presses the "select" button to close switch Sw3, whereupon microcontroller blanks the display, reads the selected game parameters, and places the selected game number in the "game" register (memory location) for later use by the program. A virtual (or software) counter (not the hardware counter 24 of either disclosed embodiment)) is implemented as a software loop consisting of multiple commands (instructions). Under program control, the microcontroller executes these instructions sequentially, initiating what is termed a "software count function." That is, the software counter increments through a sequence of all allowable numbers in the game being played, and repeats this cycle continuously until the user again presses the "select" button. The number present in the software counter at that moment is displayed (by digital displays 32, 34) and retained in the device's memory for later playback. It should be noted that, while the count would normally be in a continuous sequence from the lowest to the highest allowable number, such is not necessarily the case. For example, one of the games may be in the nature of a dice game, using the usual pair of six-sided dice. For each "roll" of the dice there are 36 possible combinations of die faces. These 36 combinations may be listed in a look-up table and accessed in non-sequential order, although each possible combination is included in every iteration.

Assuming the selected game requires that multiple numbers be selected, the computer automatically resumes the counting cycle and continues until the user again presses the "select" button. The second number, i.e., the number present in the counter when the "select" button is next pressed, is displayed and entered in memory. This process continues, with a number being selected (displayed and entered in memory) each time the user presses the "select" button until the requisite number of selections has been made. When the last number in the set is selected and displayed, LED 40 lights to indicate "last #." The user may then press the "end game" button to close switch Sw5, causing the computer to enter the playback mode and cycle through the memory. Pushing the "end game" button a second time displays the selected numbers from first to last selected. This process continues until the "reset" button is pressed to close switch Sw2, permitting the same number selection process to be repeated or allowing a new game number to be entered via switch Sw4.

There are some lottery games (e.g., Keno) in which the user decides the number of selections to be made. When playing such games, the device has no parametric information relating to the number of selections. When the designator for a Keno-type game is entered via switch Sw4, successive selections will be made, up to a predetermined maximum (e.g., 20), until the user presses the "end game" button (Sw5) to indicate that the desired number of selections has been made. Upon pressing of the "end game" button, the playback mode is activated and continues until the "reset" button is pressed, indicating initiation of another game.

It will be noted that the numbers are not selected in an entirely random manner as they are when the counting cycle of a clock is automatically interrupted at a time which is a function of the electronics of the device, nor is it a pseudo random event dictated by a mathematical algorithm. In effect, the user's personal sense of timing is what determines the number which is ultimately displayed. In the present invention counting is interrupted, and the number in the counter at that moment is selected and displayed, under the control of the user, even though the user does not know the number in the counter at any given moment and thus does not mentally pick the selected number. The base oscillator frequency is established by capacitor 42.

Figure 1A:
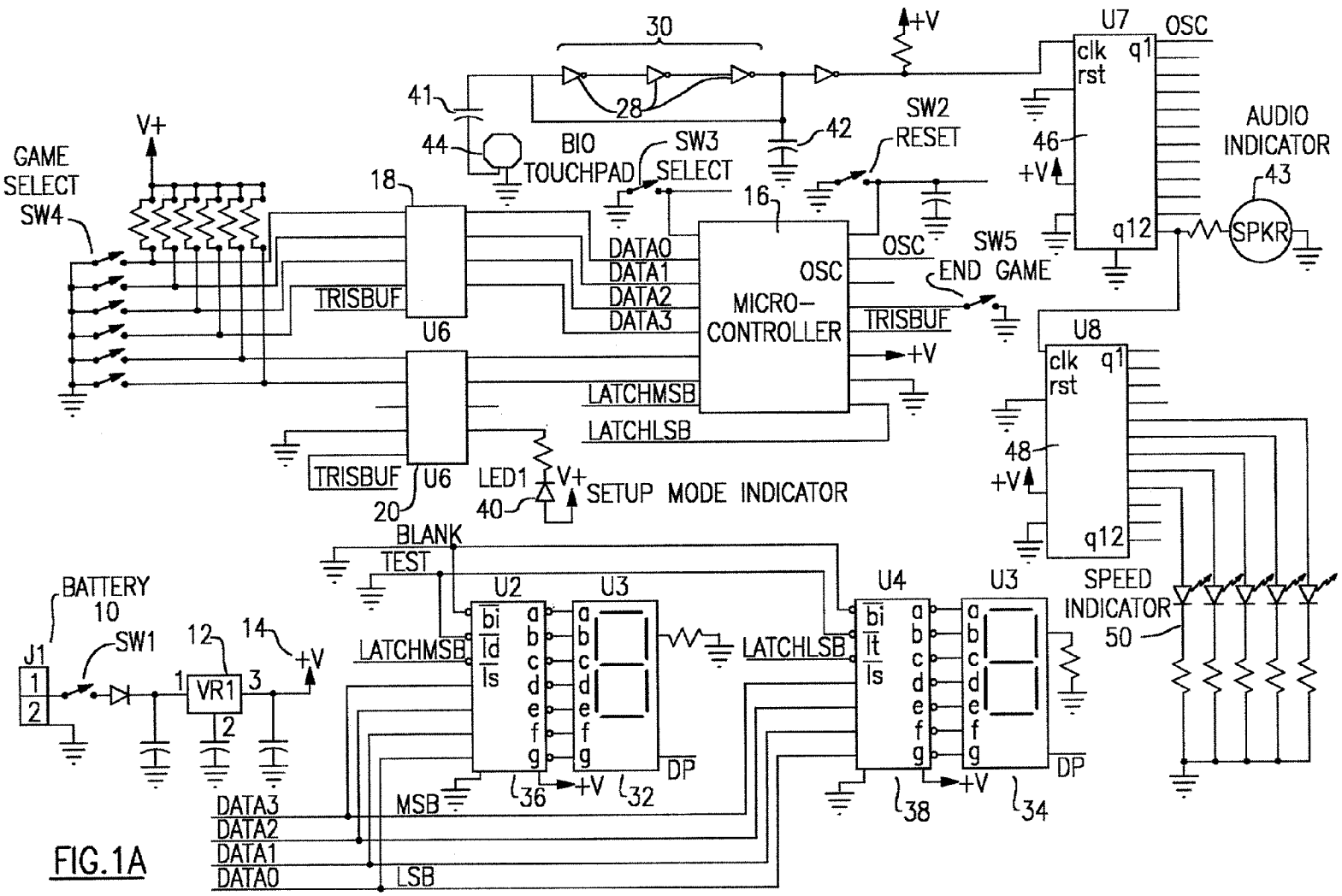
FIG. 1A is the schematic of FIG. 1 with additional elements, forming a second embodiment.

An alternate version of the circuit is shown schematically in FIG. 1A. This circuit includes all features of the circuit of FIG. 1, as just described, and further includes means for varying the oscillator frequency (counting rate of both the hardware and firmware counters) and visible and/or audible indicia relating to counter speed. Sensor 44 provides an electrical input to oscillator 30 which is used as a detuning component of the circuit to reduce the counting speed. For example, sensor 44 may be in the nature of a "bio-feedback" touchpad which is contacted by the user's hand, thumb or finger(s) when the device is held in the hand and operated. The reactance of the user's hand provides an electrical input to the circuit, slowing the oscillator frequency proportionately to the value of the signal (reactance). The device is operated in the same manner as the previously described embodiment with each number selected at the moment the user presses the "select" button. However, the counting speed is varied as a function of the signal provided by sensor 44, which tends to be a constantly variable dynamic, lending a further degree of interest to the number selection process. Of course, there are many parameters other than reactance of the user's body which may be used to provide the detuning component in proportion to which oscillator frequency is varied. To give only a few examples, these could include one or more of: the user's body temperature (internal or epidermal), blood pressure, or respiration rate, as well as environmental factors such as barometric pressure, air temperature, and light level. EEG pads, which measure brain wave activity are a prime candidate for bio sensory input to the device. Wired or wireless means could be employed to connect the device to such sensors.

A secondary means for varying the counting rate is to program various delay loops in software between count steps based on the sensor data being read at the moment. Hardware variation in the oscillator circuit and software variation in the program can occur simultaneously, accommodating simultaneous sensor inputs. Some of these parameters may be sensed directly by means incorporated in the device while others may be measured independently of the device and entered, for example, via a rotary switch which is adjusted to vary the value of the signal providing the detuning component. As a further refinement, when the device includes the counter speed variation feature, it is preferred that a visual or audible indication of clock speed be provided. To that end, hardware counters 46 and 48 (successive stages of flip-flops) provide inputs to an array of LEDs 50 which cycle (scroll) at a rate proportional to counter speed. Also, signal frequency is divided by 2 at each stage of the counter, thus being slower by half at each successive stage until the frequency becomes slow enough to cause the LEDs to scroll at a visually perceptible rate. The LEDs (and/or audio device 43) are physically connected to the slower nodes of the hardware counter.

Figure 2A:
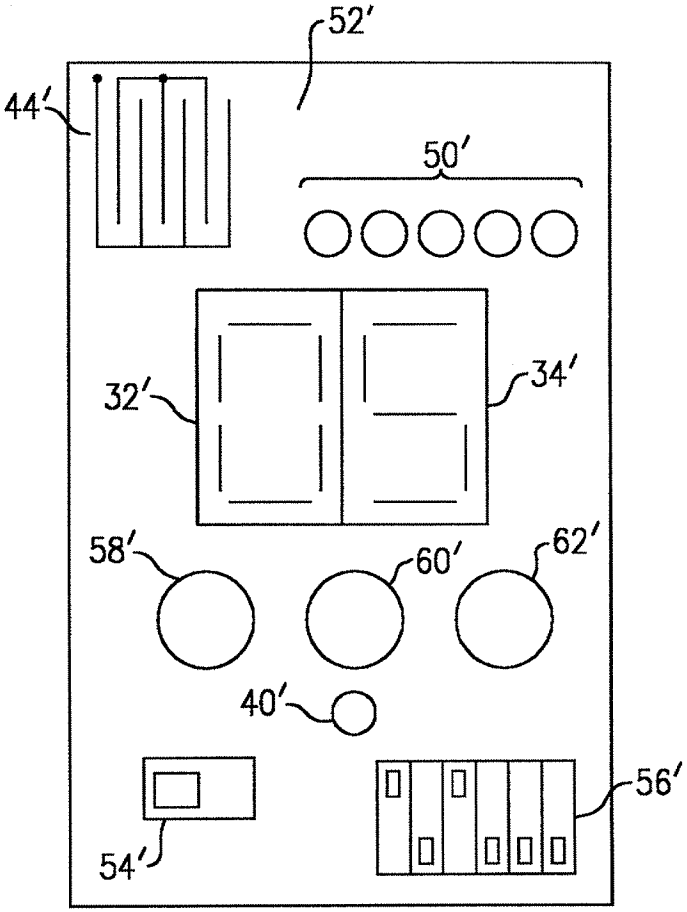
FIG. 2A is a front view of the case of FIG. 2, modified to include the additional circuit elements of FIG. 1A.
Figure 2:
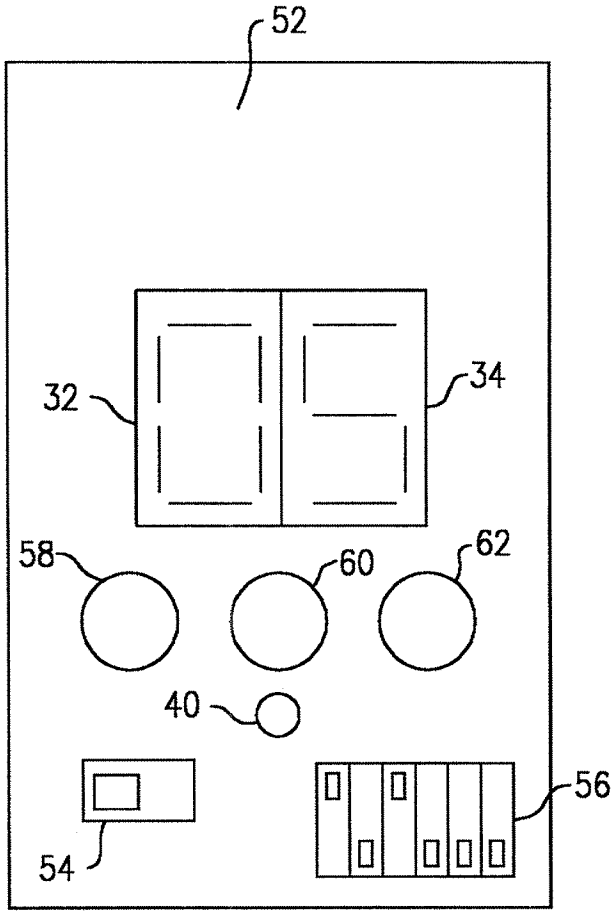
FIG. 2 is a front view of a handheld case containing, or having mounted thereon, elements of the circuit shown schematically in FIG. 1.
Figures 3, 3A:
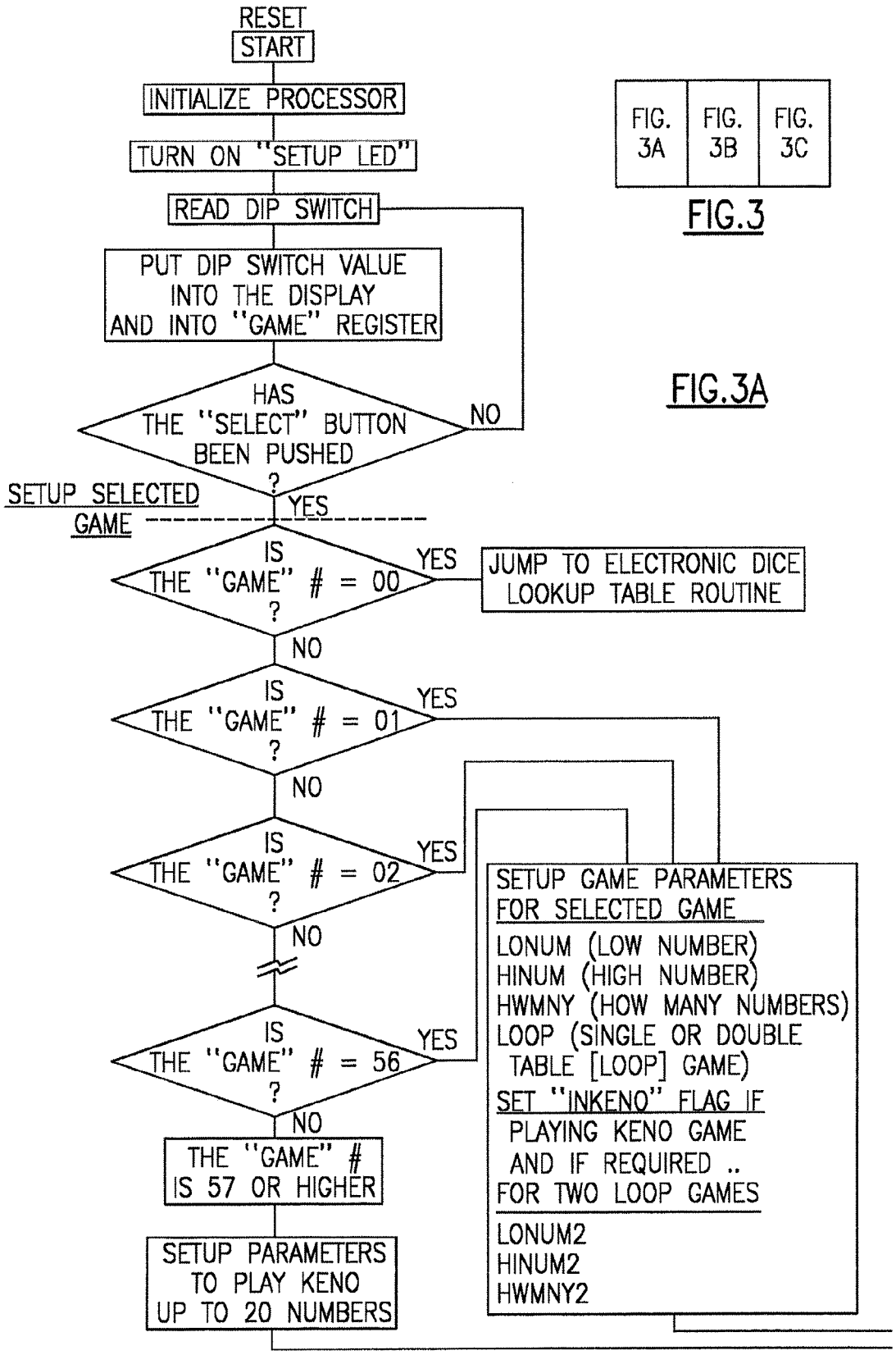
FIG. 3 is a logic block diagram illustrating operational features of the invention.
FIGS. 3A through 3C are detailed flowcharts showing the operational features of FIG. 3.
Figure 3B:
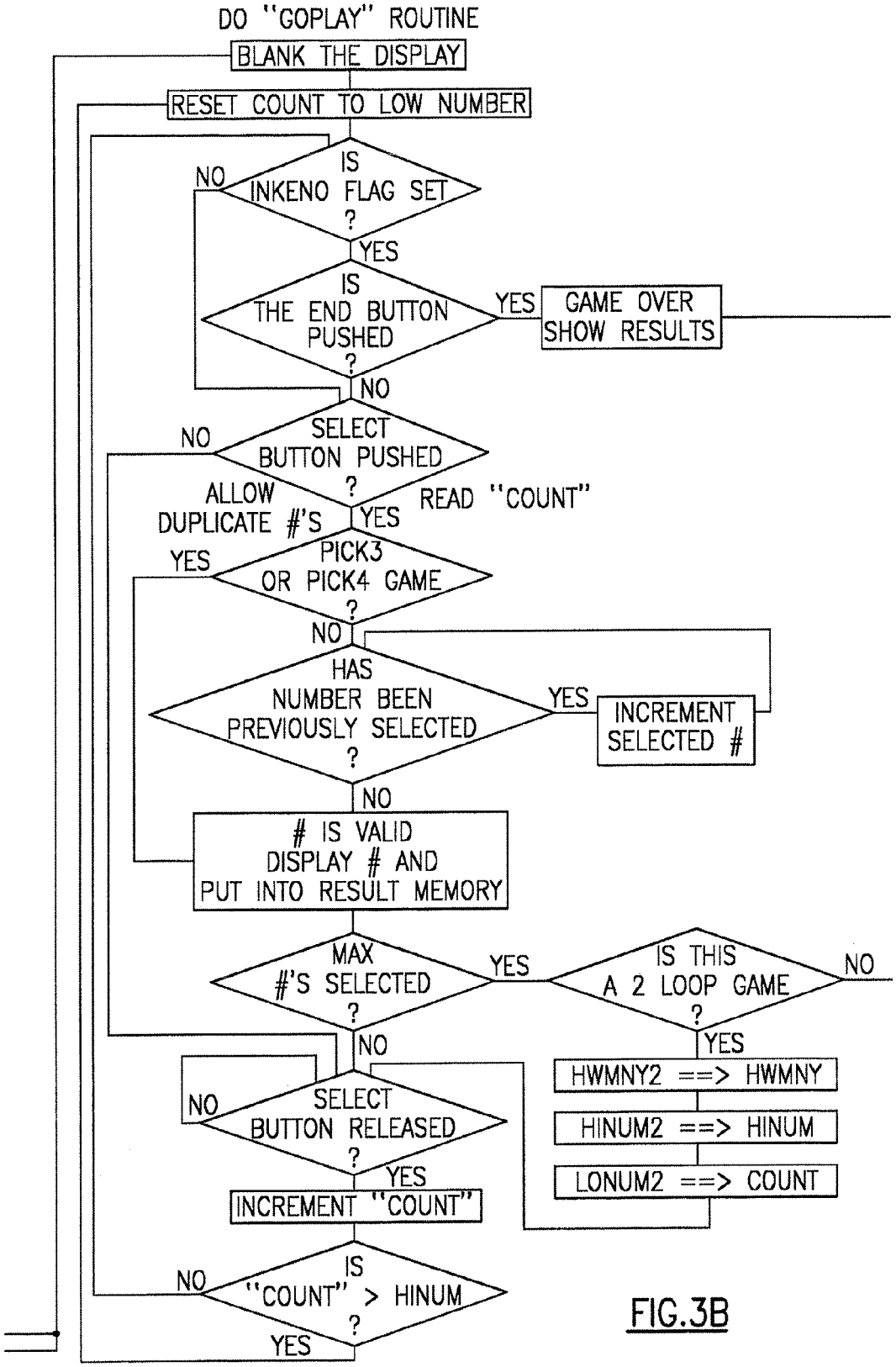
Figure 3C:
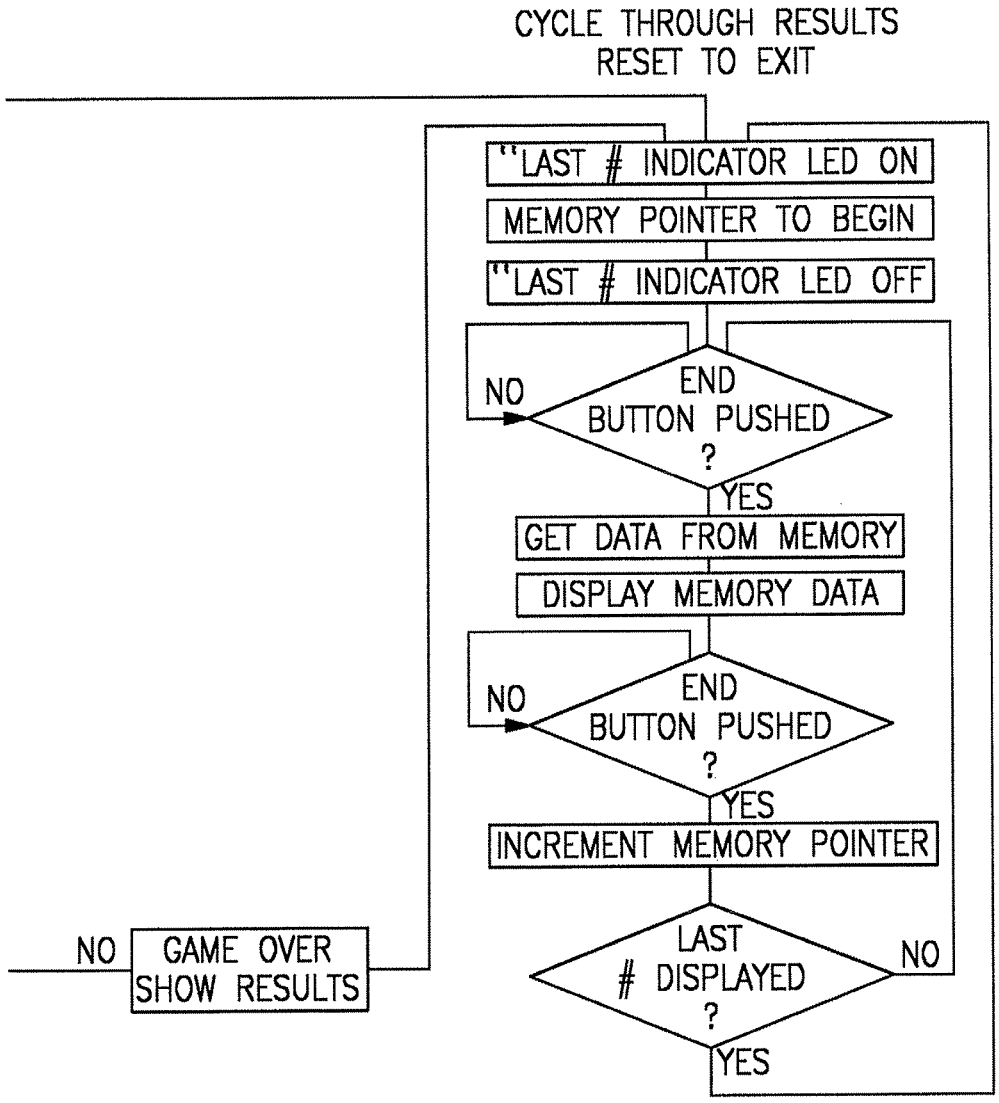

In FIG. 2 is illustrated an example of a hand held device including casing 52, within which the circuitry of FIG. 1 is enclosed, and upon which the displays and manually operated buttons are mounted. Toggle switch 54, at the lower left of the casing face, provides manual operation of on/off switch Sw1. Game Select switch Sw4 is operated by selective positioning of the six buttons at lower right denoted collectively by reference numeral 56. The switches indicated as Sw2, Sw3 and Sw5 in the schematic of FIG. 1 are in the form of momentary push-button switches actuated by pressing buttons 58, 60, and 62, respectively, on case 52. The LED indicating game setup and last number is denoted by reference numeral 40 in both FIGS. 1 and 2. Digital displays 32 and 34 are positioned above switches 58, 60 and 62.

Case 52' of FIG. 2A is a physical implementation of the schematic illustration of FIG. 1A. The elements common to the FIG. 2 embodiment are indicated in FIG. 2A by the same reference numerals with a prime sign (') added. In addition to the common elements, case 52' includes, mounted above the two-digit display, five LEDs indicated collectively by reference numeral 50, the same numeral used in FIG. 1A to denote the schematic version of the LEDs which are cycled to provide a visual indication of relative counting speed. Also shown in FIG. 2A is input device 44, again using the same reference numeral as in the schematic, which may simply be a piece of copper tape affixed in the indicated or other desired position on the case and electrically connected to the oscillator circuit as shown in the schematic. As earlier indicated, device 44 may be a touchpad responsive to reactance of a portion of the user's hand which holds casing 52' during operation thereof, or other sensor or input device which furnishes a detuning component to oscillator 30 affecting the frequency thereof. Operations are performed by the user in the same manner and sequence for the circuit and physical components of the FIG. 1A/2A embodiment as for the FIG. 1/2 embodiment when input device 44 operates automatically in response to a sensed condition. If input device 44 must be manipulated in some manner by the user, as in the case, for example, of a rotary switch, then this additional operation is performed. In any event, the number in the counter at the moment the user presses "Select" button 60, is displayed and stored in the device memory.

The invention also contemplates modifications wherein the parametric game data is stored separately in an erasable, electrically programmable memory (EEPROM, FLASH, or equivalent). This would allow the user to keep the device data-current as various games are added or deleted, or parameters (range of numbers, number of selections) of existing games are changed. One means of implementing this would be for the user to access an internet website where a file containing the current version of the parametric data is stored. The device could then incorporate one or more commercially available hardwired or wireless interface connection, such as a USB port or RS232 serial port, and could make use of future standard interfaces as they become generally available. The user would connect the device to the computer using the interface hardware, select the file to download and press a button on either the device or the computer (keyboard or mouse click) to initiate the download. Under program control, the device would rewrite the information in the EEPROM, FLASH, or the like, thus updating the device. Any of a number of schemes could be used to invoke the reprogramming algorithm, e.g., reserving one of the settings on the "game select" switch for this function. The non-reprogrammable model is intended to be sufficiently economical to make replacement practical; however, the reprogrammable device would be more flexible and convenient.

From the foregoing it will be understood that the present invention provides electronic means for and methods of selecting numbers in a manner especially suited to lottery type games wherein numbers are selected according to parametric game data which specify such parameters as the range of numbers from which selections are made, the number of selections to be made, and the like. This data is stored for a plurality of games with means provided, e.g., in the form of manually manipulated switch means on a handheld device, for selecting the game or type of game to be played; that is, the user manipulates switch(es) telling a microcontroller which set of parametric game data is to be used for a given game. It should be noted here that a myriad of input options are suitable to the game select function. Keypads, sequence switches, software display/select prams are just a few of the optional means which could perform this function. A conventional oscillator is connected to the clock input of the microcontroller through the first stage of a hardware counter, converting the pulse output of the oscillator to the square wave input required by the controller. Although the oscillator operates continuously, its frequency may be varied and, in one aspect of the invention, a detuning input is provided to the oscillator to affect its frequency and thus the counting rate of the counter. Upon closing a switch, under selective control of the user, a program count function is initiated, wherein the program counter, implemented in firmware as part of the controller program, successively (although not necessarily in a continuous sequence) counts through the allowable numbers of the game for which numbers are being selected. Also at the closing of a switch (in the disclosed embodiment, the same switch used to initiate the program count function) the count is interrupted (by the program of the microcontroller) and the number present in the software counter at that moment becomes the selected number. The selected number is indicated in some perceptible form to the user and, preferably, stored in memory for later retrieval. Although a digital display for visually indicating the selected number has been shown and described, the invention also contemplates a version wherein the digital display and associated drivers are replaced with a voice chip and speaker capable of verbalizing the chosen numbers, which could prove useful to sight impaired users of the device.

The closing of the switch to make a number selection is entirely under the control of the intuitive timing of the user of the device although, as pointed out earlier, the user has no way of knowing what number will be selected at the moment of switch closing. This is the case both when the oscillator frequency is fixed and when means are provided to vary the frequency and thus the counting rate. The microcontroller operates its program at the clock rate it receives from the oscillator (through the first counter stage to provide the required square wave) even though this rate may be varying as the device operates.

What is claimed is:

1. A handheld device for randomly selecting at least one number, comprising:

a sensor for detecting a variable biometric parameter of a user in proximity to said sensor and outputting an electrical signal that varies based on said variable biometric parameter;

a square wave oscillator for providing an output signal having a base frequency, wherein said oscillator is connected to said sensor so that said base frequency is modulated by said variable electrical signal;

a microcontroller coupled to said oscillator to receive said output signal at a clock input of said microcontroller, wherein said microcontroller is programmed to increment through a sequence of numbers at a rate determined by said output signal.

2. The device of claim 1, further comprising a user interface connected to said microcontroller, wherein said user interface includes an input for interrupting said microcontroller when incrementing through said sequence of numbers to select a particular number.

3. The device of claim 2, wherein said user interface includes a second input for allowing a user to input a range of numbers to comprise said sequence of numbers that are incremented by said microcontroller.

4. The device of claim 3, wherein said user interface includes a third input for allowing a user to select one of a plurality of inputted ranges of numbers to comprise said sequence of numbers that are incremented by said microcontroller.

5. The device of claim 4, further comprising a display connected to said microcontroller.

6. The device of claim 5, wherein said microcontroller is programmed to display said particular number selected by said user on said display after said user interrupts the incrementing through said sequence of numbers.

7. The device of claim 6, wherein said microcontroller is programmed to display a user perceptible indicia corresponding to the base frequency of said oscillator.

8. The device of claim 7, further comprising a fourth user input for reinitiating incrementing through said sequence of numbers.

9. The device of claim 8, wherein said microcontroller is programmed to reinitiate incrementing through said sequence of numbers in response to activation of said fourth user input.

10. The device of claim 9, wherein said microcontroller is programmed to reinitiate incrementing through said sequence of numbers a predetermined number of times.

11. The device of claim 10, further comprising an interface connected to said microcontroller, wherein said microcontroller is programmed to receive instructions through said interface that define the predetermined number of times that said microcontroller can reinitiate incrementing through said sequence of numbers.

* * * * *